US007454919B2

(12) United States Patent
Ookoshi et al.

(10) Patent No.: US 7,454,919 B2
(45) Date of Patent: Nov. 25, 2008

(54) HOT-WATER SUPPLY APPARATUS

(75) Inventors: Seiji Ookoshi, Fuji (JP); Tomoaki Tanabe, Fuji (JP); Masaaki Sato, Fuji (JP); Masato Hori, Fuji (JP); Yoshiteru Yamazaki, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 11/862,764

(22) Filed: Sep. 27, 2007

(65) Prior Publication Data

US 2008/0092568 A1 Apr. 24, 2008

Related U.S. Application Data

(63) Continuation of application No. PCT/JP2006/300253, filed on Jan. 12, 2006.

(30) Foreign Application Priority Data

Mar. 28, 2005 (JP) ..... 2005-092742

(51) Int. Cl.
*F25D 21/06* (2006.01)
*F25D 21/12* (2006.01)

(52) U.S. Cl. ..... 62/156; 62/82; 62/160; 62/196.4; 62/278

(58) Field of Classification Search ..... 62/80, 62/81, 82, 151, 156, 160, 196.4, 272, 278
See application file for complete search history.

(56) References Cited

U.S. PATENT DOCUMENTS 4,727,727 A * 3/1988 Reedy ..... 62/238.6
4,766,734 A * 8/1988 Dudley ..... 62/160
6,418,737 B1 * 7/2002 Kuroki et al. ..... 62/156
6,668,572 B1 * 12/2003 Seo et al. ..... 62/238.6
7,028,494 B2 * 4/2006 Pondicq-Cassou et al. . 62/196.4
7,228,692 B2 * 6/2007 Concha et al. ..... 62/151
2007/0204636 A1 * 9/2007 Concha et al. ..... 62/156

FOREIGN PATENT DOCUMENTS

| | | |
|---|---|---|
| JP | 60-29562 | 2/1985 |
| JP | 63-223458 | 9/1988 |
| JP | 2-25106 | 5/1990 |
| JP | 2004-183908 | 7/2004 |

OTHER PUBLICATIONS

International Preliminary Report on Patentability issued in counterpart International Application no. PCT/JP2006/300253 dated Oct. 11, 2007.

* cited by examiner

*Primary Examiner*—Marc E Norman
(74) *Attorney, Agent, or Firm*—DLA Piper LLP US

(57) ABSTRACT

Defrosting operation is possible by causing refrigerant discharged from a compressor to flow to an outdoor heat exchanger, and returning the refrigerant passed through the outdoor heat exchanger to the compressor through a water-heat exchanger, while operating a pump. Quick defrosting operation is possible by causing refrigerant discharged from a compressor to flow to an outdoor heat exchanger, and returning the refrigerant passed through the outdoor heat exchanger directly to the compressor, while stopping a pump. The temperature of water that has flowed into a water-heat exchanger is detected. According to the detected temperature, the defrosting operation using hot water and quick defrosting operation are selectively executed.

9 Claims, 3 Drawing Sheets

HOT-WATER SUPPLY APPARATUS

CROSS REFERENCE TO RELATED APPLICATIONS

This is a Continuation Application of PCT Application No. PCT/JP2006/300253, filed Jan. 12, 2006, which was published under PCT Article 21(2) in Japanese.

This application is based upon and claims the benefit of priority from prior Japanese Patent Application No. 2005-092742, filed Mar. 28, 2005, the entire contents of which are incorporated herein by reference.

BACKGROUND OF THE INVENTION

1. Field of the Invention

The present invention relates to a hot-water supply apparatus, which stores hot water in a hot-water tank by circulating water of a hot-water tank through a water-heat exchanger of a heat pump refrigeration cycle.

2. Description of the Related Art

There is a hot-water supply apparatus, which has a heat pump refrigeration cycle having a compressor, a water-heat exchanger and an outdoor heat exchanger, and stores hot water in a hot-water tank by circulating water of a hot-water tank through a water-heat exchanger by operating a pump.

In this hot-water supply apparatus, frost gradually forms on the surface of an outdoor heat exchanger functioning as an evaporator, and it is necessary to eliminate the frost from the outdoor heat exchanger periodically or as needed.

As a method of eliminating frost, there is a known method called reverse cycle defrosting, which reverses the flow of refrigerant in a heat pump refrigeration cycle, and supplies a high-temperature refrigerant ejected from a compressor directly to an outdoor heat exchanger.

There is another method (Jpn. Pat. Appln. KOKAI Publication No. 2004-183908), which causes hot water of a hot-water tank to flow to a water-heat exchanger, and transfers the heat of the hot water to the refrigerant, while performing a reverse cycle defrosting. This method can reduce the time required to defrost, compared with the method of executing only a reverse cycle defrosting.

BRIEF SUMMARY OF THE INVENTION

The method of using the heat of hot water of a hot-water tank to eliminate frost while performing a reverse cycle defrosting is advantageous in reducing the time required to defrost, as described above, but disadvantageous in that a water-heat exchanger is frozen when low-temperature water flows in a water-heat exchanger.

It is an object of a hot-water supply apparatus according to the present invention to prevent freezing of a water-heat exchanger while reducing time required for defrosting an outdoor heat exchanger.

According to an aspect of the present invention, there is provided a hot-water supply apparatus, which has a heat pump refrigeration cycle having a compressor, a water-heat exchanger and an outdoor heat exchanger, and stores hot water in a hot-water tank by circulating water of a hot-water tank through a water-heat exchanger by operating a pump, comprising:

a control section of a defrosting operation using hot water, which causes refrigerant discharged from the compressor to flow to the outdoor heat exchanger, and returns the refrigerant passed through the outdoor heat exchanger to the compressor through the water-heat exchanger, while operating the pump;

a control section of a quick defrosting operation, which causes refrigerant discharged from the compressor to flow to the outdoor heat exchanger, and returns the refrigerant passed through the outdoor heat exchanger directly to the compressor, while stopping the pump;

a temperature sensor which detects a temperature of water that has flowed into the water-heat exchanger; and a control section for temperature control, which selectively executes the defrosting operation using hot water, and quick defrosting operation, according to the temperature detected by the temperature sensor.

DETAILED DESCRIPTION OF THE INVENTION

Hereinafter, an embodiment of the invention will be explained with reference to the accompanying drawings.

Figure 1:
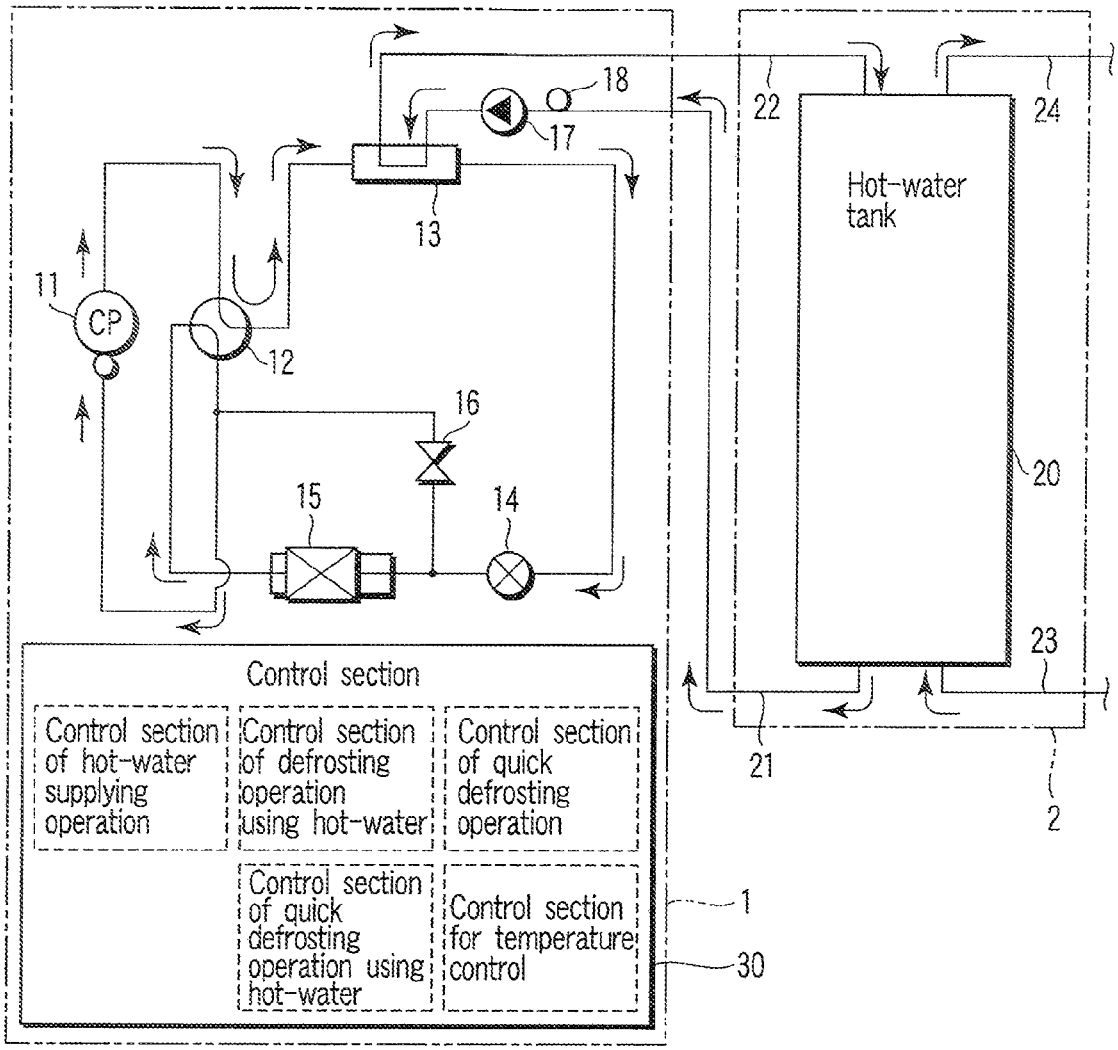
FIG. 1 is a view showing the configuration of an embodiment of the invention, the flow of refrigerant when storing hot water, and the flow of hot water when supplying hot water.

As shown in FIG. 1, a hot-water supply apparatus comprises a heat source unit 1 and a hot-water tank unit 2.

The heat source unit 1 has a heat pump refrigeration cycle formed by sequentially piping and connecting a compressor 11, a four-way valve 12, a water-heat exchanger 13, a flow rate control valve 14 and an outdoor heat exchanger 15. In the piping between the flow rate control valve 14 and outdoor heat exchanger 15 to the piping of the suction side of the compressor 11, a bypass 19 is connected through a two-way valve 16. An externally guided circulation piping (water side) 21 is connected to the inlet side of the water-heat exchanger 13 through a pump 17, and a circulation piping (hot-water side) 22 is connected to the outlet side of the water-heat exchanger 13. The circulation piping (hot-water side) 22 is guided to the outside. The circulation piping 21 is provided with a temperature sensor 18 to detect the temperature Twi of water flowing into the water-heat exchanger 13.

The hot-water tank unit 2 has a hot-water tank 20, takes water supplied from a water supply piping 23 in the lower part of the hot-water tank 20, causes water (or hot water) in the hot-water tank 20 to flow to the circulation piping 21, takes hot water guided from the circulation piping (hot-water side) 22 in the upper part of the hot-water tank 20, and supplies hot water in the hot-water tank 20 to a hot-water supply piping 24.

The heat source unit 1 is provided with a control section 30. The control section 30 has the following control sections (1)-(5) as main functions.

(1) A control section of a hot-water supplying operation, which causes refrigerant discharged from the compressor 11 to flow to the water-heat exchanger 13 through the four-way valve 12, and returns the refrigerant passed through the water-heat exchanger 13 to the compressor 1 through the flow rate control valve 14, outdoor heat exchanger 15 and four-way valve 12, while operating the pump 17.

(2) A control section of a defrosting operation using hot water, which causes refrigerant discharged from the compressor 11 to flow to the outdoor heat exchanger 15 through the four-way valve 12, and returns the refrigerant passed through the outdoor heat exchanger 15 to the compressor 11 through the flow rate control valve 14, water-heat exchanger 13 and four-way valve 12, while operating the pump 17.

(3) A control section of a quick defrosting operation, which causes refrigerant discharged from the compressor 11 to flow to the outdoor heat exchanger 15 through the four-way valve 12, and returns the refrigerant passed through the outdoor heat exchanger 15 to the compressor 11 by bypassing through a two-way valve 16, while stopping the pump 17.

(4) A control section of a quick defrosting operation using hot water, which causes refrigerant discharged from the compressor 11 to flow to the outdoor heat exchanger 15 through the four-way valve 12, and returns the refrigerant passed through the outdoor heat exchanger 15 to the compressor 11 through the flow rate control valve 14, water-heat exchanger 13 and four-way valve 12, and returns a part of the refrigerant passed through the outdoor heat exchanger 15 to the compressor 11 by bypassing through the two-way valve 16, while operating the pump 17.

(5) A control section for temperature control, which selectively executes the defrosting operation using hot water, quick defrosting operation, and quick defrosting operation using hot water, according to a temperature Twi detected by the temperature sensor 18.

Hereinafter, explanation will be given on the hot-water supplying operation, hot-water storing operation and defrosting operation.

[a] Hot-Water Supplying Operation

Water for supplying flows into the lower part of the hot-water tank 20 through the water supply piping 23, and hot water in the upper part of the hot-water tank 20 flows out to the hot-water supply piping 24. The hot water that has flowed out to the hot-water supply piping 24 is sent to a predetermined place through the hot-water supply piping 24.

[b] Hot-Water Storing Operation

The flows of hot water and refrigerant in the hot-water storing operation are indicated by arrows in FIG. 1. The compressor 11 is operated, the refrigerant discharged from the compressor 11 is absorbed by the compressor 1 through the four-way valve 12, water-heat exchanger 13, flow rate control valve 14, outdoor heat exchanger 15 and four-way valve 12. The pump 17 is operated.

As the pump 17 is operated, water (or hot water) in the lower part of the hot-water tank 20 flows into the circulation piping 21. Then, the water (or hot water) flows into the water-heat exchanger 13 through the pump 17, and absorbs heat from refrigerant of a heat pump refrigeration cycle, thereby the temperature of the water is increased. The temperature-increased water flows from the water-heat exchanger 13 to the circulation piping 22. The hot water that has flowed into the circulation piping 22 flows into the upper part of the hot-water tank 20. Accompanying with this water flowing, water (or hot water) flows again from the lower part of the hot-water tank 20 to the circulation piping 21, as described above.

How water is stored in the hot-water tank 20 in this way, by circulating water (or hot water) between the water-heat exchanger 13 and hot-water tank 20.

[c] Defrosting Operation

Figure 2:
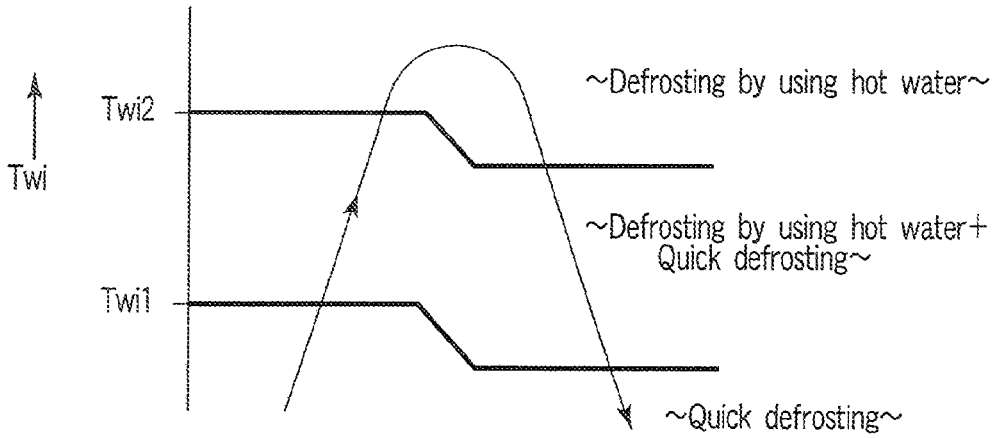
FIG. 2 is a view showing the conditions for selecting defrosting operation modes in an embodiment of the invention.

In the hot-water storing operation, a defrosting operation is executed to eliminate frost adhering to the outdoor heat exchanger 15, periodically or as needed (according to the temperature of the outdoor heat exchanger 15). The defrosting operation is available in three modes: defrosting by using hot water, quick defrosting, and quick defrosting by using hot water (defrosting by using hot water+quick defrosting). One of these three defrosting operation modes is selectively executed according to the temperature Twi detected by the temperature sensor 18. FIG. 2 shows the conditions for this selection.

[c-1] Defrosting Operation Using Hot Water

Figure 3:
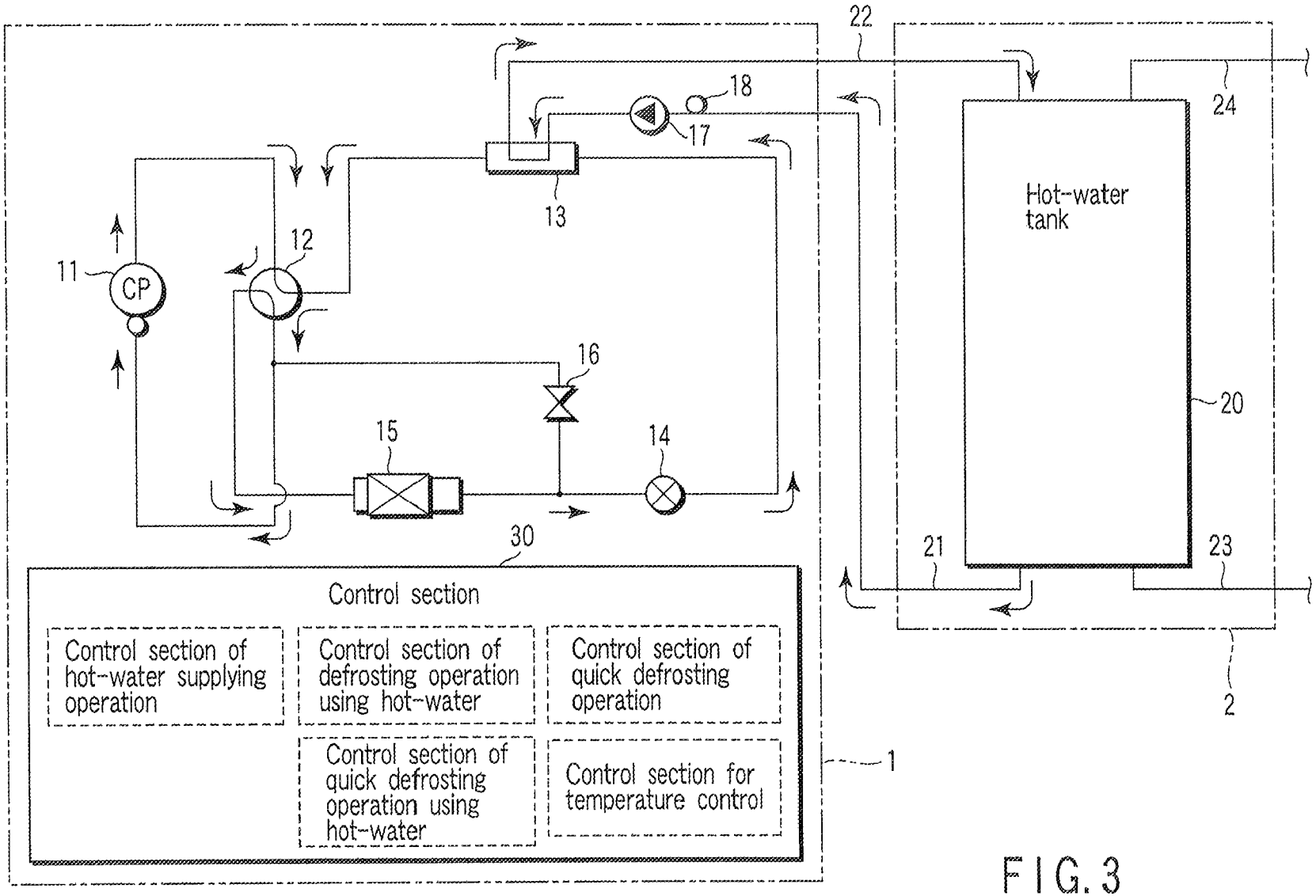
FIG. 3 is a view showing the flow of refrigerant and hot water in the defrosting operation using hot water in an embodiment of the invention.

When the temperature of hot water supplied from the hot-water tank 20 to the water-heat exchanger 13 is relatively high, and the temperature Twi detected by the temperature sensor 18 is over a preset value Twi2, the defrosting operation using hot water shown in FIG. 3 is executed.

First, the four-way valve 12 is changed over, and the high-temperature refrigerant discharged from the compressor 11 flows into the water-heat exchanger 15 through the four-way valve 12. By the high-temperature refrigerant, frost adhering to the outdoor heat exchanger 15 is eliminated.

The refrigerant passing through the outdoor heat exchanger 15 is absorbed by the compressor 1 through the flow rate control valve 14, water-heat exchanger 13 and four-way valve 12.

The pump 17 is operated, and the hot water of the hot-water tank 20 is circulated through the water-heat exchanger 13. By this circulation, the heat of hot water is given to the refrigerant and used for defrosting, thereby increasing the defrosting capacity. As the defrosting capacity is increased, the time required to defrost is reduced.

[c-2] Quick Defrosting Operation

Figure 4:
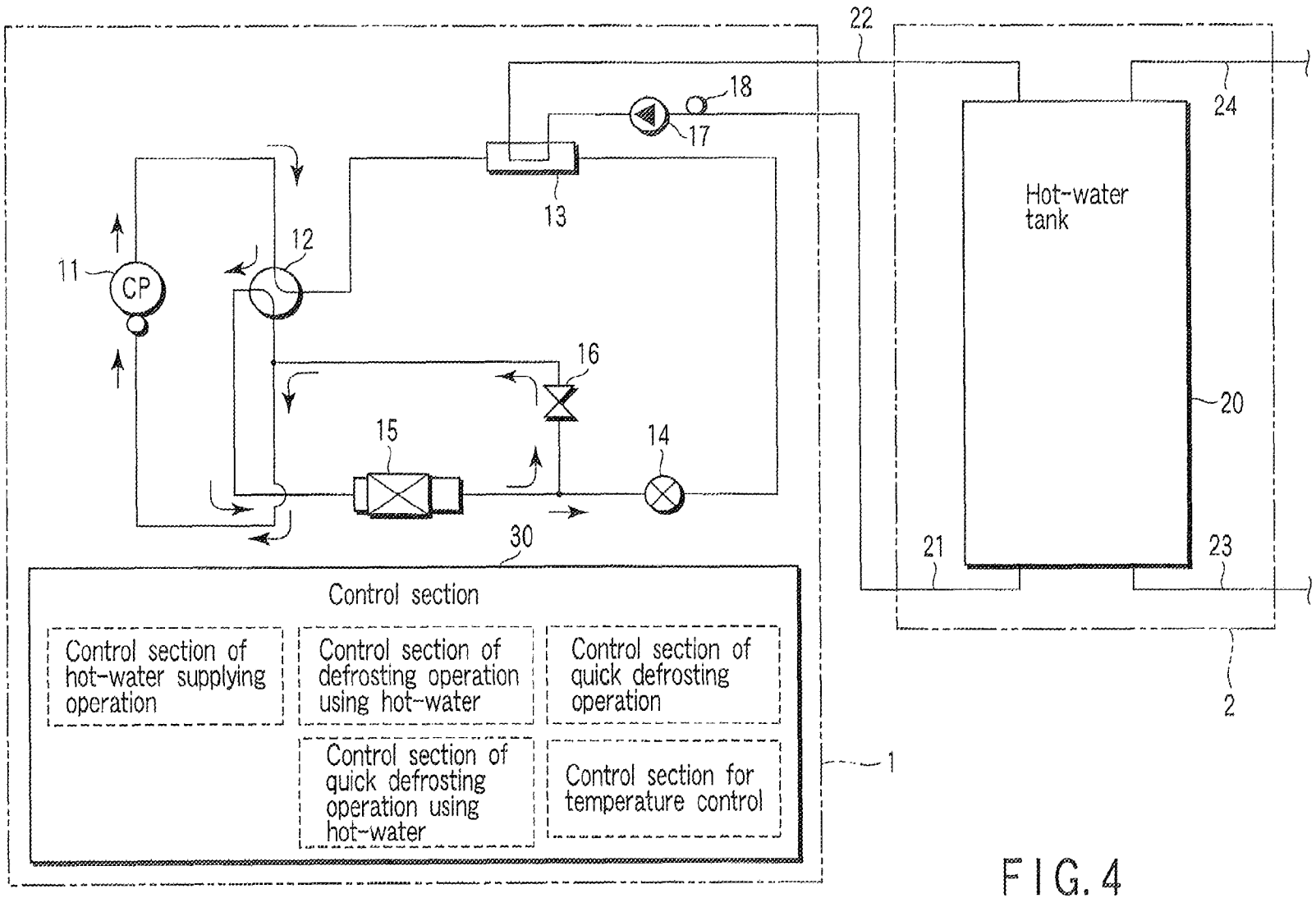
FIG. 4 is a view showing the flow of refrigerant in the quick defrosting operation in an embodiment of the invention.

When low-temperature water is supplied from the hot-water tank 20 to the water-heat exchanger 13, and the temperature Twi detected by the temperature sensor 18 is lower than a preset value Twi1, the quick defrosting operation shown in FIG. 4 is executed.

First, the four-way valve 12 is changed over, and the high-temperature refrigerant discharged from the compressor 11 flows into the water-heat exchanger 15 through the four-way valve 12. By this high-temperature refrigerant, frost adhering to the outdoor heat exchanger 15 is eliminated.

The flow rate control valve 14 is fully opened, and the refrigerant passed through the outdoor heat exchanger 15 is not allowed to flow to the water-heat exchanger 13, but bypassed to the two-way valve 16, and absorbed by the compressor 1.

The pump 17 stops, and low-temperature water is not allowed to flow to the water-heat exchanger 13.

As described above, refrigerant is not allowed to flow to the water-heat exchanger 13, and besides low-temperature water is not allowed to flow to the water-heat exchanger 13, whereby the water-heat exchanger 13 is prevented from freezing.

[c-3] Quick Defrosting Operation Using Hot Water (Defrosting by Using Hot Water+Quick Defrosting)

When the temperature Twi detected by the temperature sensor 18 is over a preset value Twi1 and below a preset value Twi2, the quick defrosting operation using hot water (defrosting by using hot water+quick defrosting) in which two defrosting operation modes shown in FIG. 3 and FIG. 4 are executed is executed.

First, the four-way valve 12 is changed over, and the high-temperature refrigerant discharged from the compressor 11 flows into the water-heat exchanger 15 through the four-way valve 12. By this high-temperature refrigerant, frost adhering to the outdoor heat exchanger 15 is eliminated.

The refrigerant decreased in temperature through the outdoor heat exchanger 15 flows into the water-heat exchanger 13 through the flow rate control valve 14, and a part of the refrigerant is bypassed through the two-way valve 16, and absorbed by the compressor 1.

The pump 17 is operated and the hot water of the hot-water tank 20 is circulated through the water-heat exchanger 13. By this circulation, the heat of hot water is given to the refrigerant and used for defrosting, thereby increasing the defrosting capacity. As the defrosting capacity is increased, the time required to defrost is reduced.

In this case, even if the refrigerant decreased in temperature in the outdoor heat exchanger 15 flows into the water-heat exchanger 13, the flow rate of the refrigerant is less by the extent equivalent to the part bypassed through the two-way valve 16, and the water-heat exchanger 13 is not frozen.

A hot-water supply apparatus according to the present invention is applicable to a hot-water supply apparatus having a fear of freezing.

What is claimed is:

1. A hot-water supply apparatus, which has a heat pump refrigeration cycle having a compressor, a water-heat exchanger and an outdoor heat exchanger, and stores hot water in a hot-water tank by circulating water of a hot-water tank through a water-heat exchanger by operating a pump, comprising:

a control section of a defrosting operation using hot water, which causes refrigerant discharged from the compressor to flow to the outdoor heat exchanger, and returns the refrigerant passed through the outdoor heat exchanger to the compressor through the water-heat exchanger, while operating the pump;

a control section of a quick defrosting operation, which causes refrigerant discharged from the compressor to flow to the outdoor heat exchanger, and returns the refrigerant passed through the outdoor heat exchanger directly to the compressor, while stopping the pump;

a temperature sensor which detects the temperature of water that has flowed into the water-heat exchanger, and a control section for temperature control, which selectively executes the defrosting operation using hot water, and quick defrosting operation, according to the temperature detected by the temperature sensor.

2. The hot-water supply apparatus according to claim 1, further comprising a control section of a hot-water supplying operation, which causes refrigerant discharged from the compressor to flow to the water-heat exchanger, and returns the refrigerant passed through the water-heat exchanger to the compressor through the outdoor heat exchanger, while operating the pump.

3. The hot-water supply apparatus according to claim 1, wherein the control section for temperature control executes the defrosting operation using hot water when a temperature detected by the temperature sensor is over a preset value, and executes the quick defrosting operation when a temperature detected by the temperature sensor is below a preset value.

4. A hot-water supply apparatus, which has a heat pump refrigeration cycle having a compressor, a water-heat exchanger and an outdoor heat exchanger, and stores hot water in a hot-water tank by circulating water of a hot-water tank through a water-heat exchanger by operating a pump, comprising:

a control section of a defrosting operation using hot water, which causes refrigerant discharged from the compressor to flow to the outdoor heat exchanger, and returns the refrigerant passed through the outdoor heat exchanger to the compressor through the water-heat exchanger, while operating the pump;

a control section of a quick defrosting operation, which causes refrigerant discharged from the compressor to flow to the outdoor heat exchanger, and returns the refrigerant passed through the outdoor heat exchanger directly to the compressor, while stopping the pump;

a control section of a quick defrosting operation using hot water, which causes refrigerant discharged from the compressor to flow to the outdoor heat exchanger, and returns the refrigerant passed through the outdoor heat exchanger to the compressor through the water-heat exchanger, and returns a part of the refrigerant passed through the outdoor heat exchanger directly to the compressor, while operating the pump;

a temperature sensor which detects the temperature of water that has flowed into the water-heat exchanger; and a control section for temperature control, which selectively executes the defrosting operation using hot water, quick defrosting operation, and quick defrosting operation using hot water, according to temperatures detected by the temperature sensor.

5. The hot-water supply apparatus according to claim 4, further comprising a control section of a hot-water supplying operation, which causes refrigerant discharged from the compressor to flow to the water-heat exchanger, and returns the refrigerant passed through the water-heat exchanger to the compressor through the outdoor heat exchanger, while operating the pump.

6. The hot-water supply apparatus according to claim 4, wherein the control section for temperature control executes the defrosting operation using hot water when a temperature Twi detected by the temperature sensor is over a preset value Twi2, and executes the quick defrosting operation when a temperature Twi detected by the temperature sensor is below a preset value Twi1 (<Twi2), and executes the quick defrosting operation using hot water when a temperature Twi detected by the temperature sensor is over a preset value Twi1 and below a preset value Twi2.

7. A hot-water supply apparatus, which has a heat pump refrigeration cycle having a compressor, a water-heat exchanger and an outdoor heat exchanger, and stores hot water in a hot-water tank by circulating water of a hot-water tank through a water-heat exchanger by operating a pump, comprising:

a control means of a defrosting operation using hot water, which causes refrigerant discharged from the compressor to flow to the outdoor heat exchanger, and returns the refrigerant passed through the outdoor heat exchanger to the compressor through the water-heat exchanger, while operating the pump;

a control, means of a quick defrosting operation, which causes refrigerant discharged from the compressor to flow to the outdoor heat exchanger, and returns the refrigerant passed through the outdoor heat exchanger directly to the compressor, while stopping the pump;

a temperature sensor which detects the temperature of water that has flowed into the water-heat exchanger; and a control means for temperature control, which selectively executes the defrosting operation using hot water, and quick defrosting operation, according to temperatures detected by the temperature sensor.

8. The hot-water supply apparatus according to claim 7, further comprising a control means of a hot-water supplying operation, which causes refrigerant discharged from the compressor to flow to the water-heat exchanger, and returns the refrigerant passed through the water-heat exchanger to the compressor through the outdoor heat exchanger, while operating the pump.

9. The hot-water supply apparatus according to claim 7, wherein the control means for temperature control executes the defrosting operation using hot water when a temperature detected by the temperature sensor is over a preset value, and executes the quick defrosting operation when a temperature detected by the temperature sensor is below a preset value.

* * * * *